US009476176B2

(12) United States Patent
Arentsen et al.

(10) Patent No.: US 9,476,176 B2
(45) Date of Patent: Oct. 25, 2016

(54) PILE DRIVER SYSTEM FOR AND METHOD OF INSTALLING FOUNDATION ELEMENTS IN A SUBSEA GROUND FORMATION

(75) Inventors: Dirk Arentsen, Leiderdorp (NL); Michael Schaap, Zwijndrecht (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 13/979,753

(22) PCT Filed: Jan. 16, 2012

(86) PCT No.: PCT/EP2012/050577

§ 371 (c)(1),
(2), (4) Date: Sep. 13, 2013

(87) PCT Pub. No.: WO2012/098081

PCT Pub. Date: Jul. 26, 2012

(65) Prior Publication Data

US 2014/0314495 A1 Oct. 23, 2014

(30) Foreign Application Priority Data

Jan. 17, 2011 (NL) ..... 2006017

(51) Int. Cl.
*E02D 7/10* (2006.01)

(52) U.S. Cl.
CPC ..... *E02D 7/10* (2013.01)

(58) Field of Classification Search
CPC ..... E02D 7/10
USPC ..... 405/228, 232; 173/127, 200, 206
See application file for complete search history.

(56) References Cited

U.S. PATENT DOCUMENTS

| | | | |
|---|---|---|---|
| 1,846,804 | A | 2/1932 | Hansen |
| 3,049,097 | A | 8/1962 | Kershaw |
| 3,200,893 | A | 8/1965 | Leavell |
| 3,456,741 | A | 7/1969 | James |

(Continued)

FOREIGN PATENT DOCUMENTS

| | | |
|---|---|---|
| EP | 301114 | 7/1987 |
| EP | 301116 | 2/1989 |

(Continued)

OTHER PUBLICATIONS

Search Report and Written Opinion for corresponding foreign appliction PCT/EP2012/050577, filed Jan. 16, 2012.

(Continued)

*Primary Examiner* — Benjamin Fiorello
(74) *Attorney, Agent, or Firm* — Steven M. Koehler; Westman, Champlin & Koehler, P.A.

(57) ABSTRACT

A pile driver system for installing or removing foundation elements, such as piles, anchors, and conductors, in a subsea ground formation, includes a closed housing defining a cavity, an impact weight accommodated inside the housing, a hydraulic circuit for reciprocating the impact weight, which circuit comprises one or more valves, a cylinder, and a piston accommodated in the cylinder and connected to the impact weight, a pump for withdrawing water from the surroundings of the pile driver and providing pressurized water to the hydraulic circuit, and at least one outlet for returning water to the surroundings. The exhaust of the hydraulic circuit communicates with the cavity and the outlet is located in the wall of the housing.

24 Claims, 1 Drawing Sheet

(56) References Cited

U.S. PATENT DOCUMENTS

| | | | | | |
|---|---|---|---|---|---|
| 3,547,207 | A | | 12/1970 | Warrington | |
| 3,583,499 | A | | 6/1971 | Cordes | |
| 3,800,548 | A | | 4/1974 | Wisotsky | |
| 3,820,346 | A | | 6/1974 | Wisotsky | |
| 3,970,156 | A | | 7/1976 | Niskin | |
| 4,033,139 | A | | 7/1977 | Frederick | |
| 4,043,405 | A | | 8/1977 | Kuhn | |
| 4,089,165 | A | | 5/1978 | Reineke, Jr. | |
| 4,187,917 | A | | 2/1980 | Bouyoucos | |
| 4,238,166 | A | | 12/1980 | Gendron | |
| 4,333,492 | A | | 6/1982 | West | |
| 4,367,800 | A | | 1/1983 | Arentsen | |
| 4,601,349 | A | | 7/1986 | Arentsen | |
| 4,818,149 | A | * | 4/1989 | Kuehn | 405/228 |
| 4,872,514 | A | * | 10/1989 | Kuehn | 173/132 |
| 5,662,175 | A | | 9/1997 | Warrington | |
| 8,353,360 | B2 | * | 1/2013 | Slot et al. | 173/90 |
| 2011/0123277 | A1 | * | 5/2011 | Westerbeek et al. | 405/228 |

FOREIGN PATENT DOCUMENTS

| | | |
|---|---|---|
| EP | 675233 | 8/1992 |
| GB | 2078148 | 2/1980 |
| GB | 2069034 | 8/1981 |
| GB | 2069902 | 9/1981 |
| SU | 647404 | 2/1979 |

OTHER PUBLICATIONS

Australian Examination Report dated Apr. 11, 2016 for corresponding Australian Application No. 2012208656.

European Office Action for related European patent application No. 12702197.0, dated May 12, 2016.

* cited by examiner

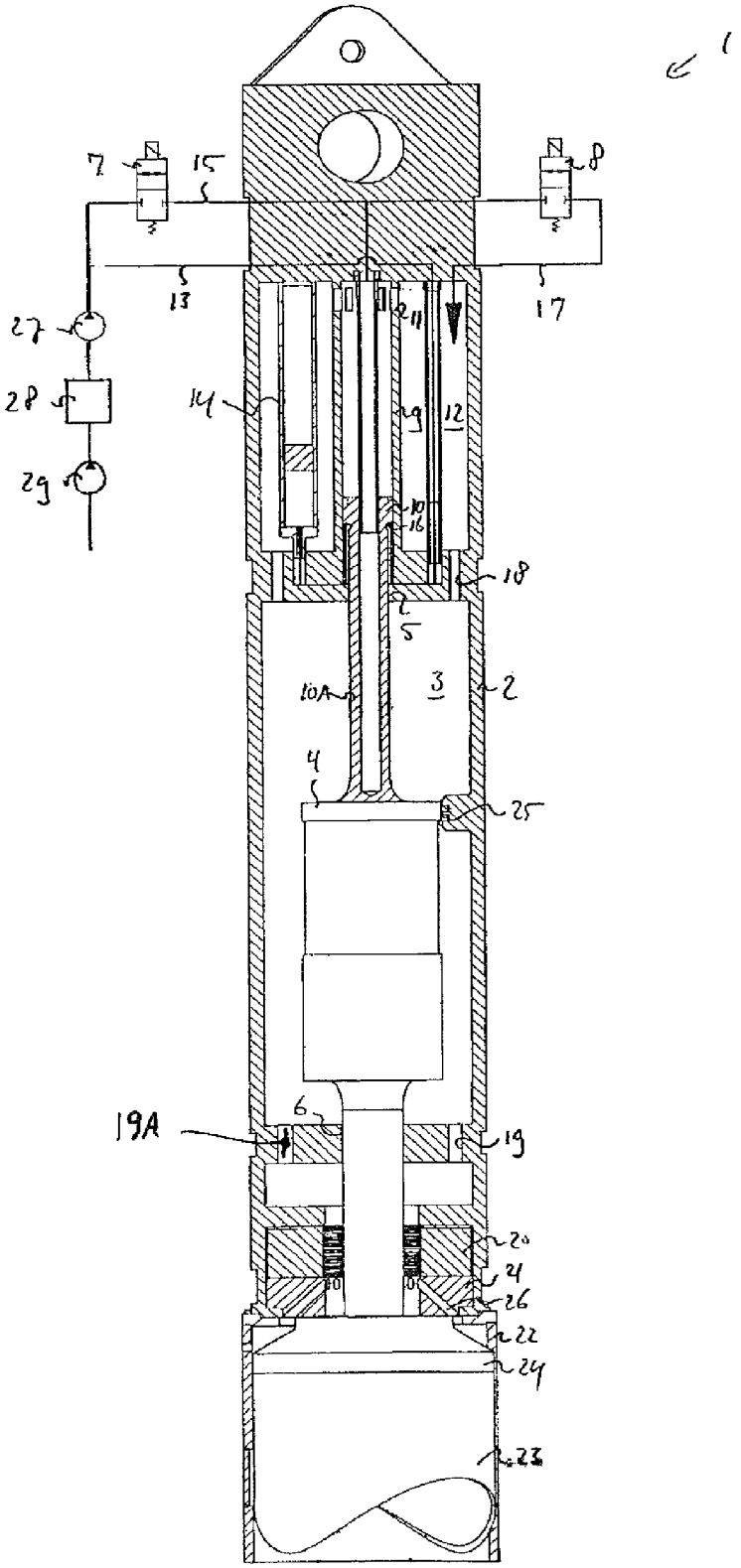
1
7
15
8
13
17
27
28
29
14
11
9
12
10
16
18
5
10A
3
2
4
25
19A
6
19
20
21
26
22
24
23

PILE DRIVER SYSTEM FOR AND METHOD OF INSTALLING FOUNDATION ELEMENTS IN A SUBSEA GROUND FORMATION

CROSS-REFERENCE TO RELATED APPLICATION

The present application is a Section 371 National Stage Application of International patent application Serial No. PCT/EP2012/050577, filed Jan. 16, 2012, and published as WO 2012/098081 A1 in English.

BACKGROUND

Aspects of the invention relate to a pile driver system for installing or removing (decommissioning) foundation elements, such as piles, anchors, and conductors, in a subsea ground formation, comprising a closed housing defining a cavity, an impact weight accommodated inside the housing, i.e. in the cavity and enveloped by the housing, and a hydraulic circuit for reciprocating the impact weight. The circuit comprises one or more valves, a cylinder, and a piston accommodated in the cylinder and connected to the impact weight, e.g. forming an integral whole with the impact weight or rigidly connected to the impact weight. The system further comprises a pump for withdrawing water from the surroundings of the pile driver and providing pressurized water to the hydraulic circuit. An aspect of the invention further relates to a method of installing or removing foundation elements.

SUMMARY

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

An aspect of the invention is an improved hydraulic pile driver which uses water as working fluid.

To this end, the exhaust of the hydraulic circuit communicates with the cavity and one or more outlets are located in the wall of the housing. In an embodiment, the outlet is located near or in the bottom of the housing.

By returning the pressurized water to the surroundings via the cavity, preferably via the entire length of the cavity, ingress of water and dirt directly from the surroundings into the cavity, e.g. as a result of pumping action generated by the reciprocating impact weight, is reduced or prevented.

In an embodiment, the pile driver comprises an upper bearing and/or a lower bearing for guiding an upper and/or lower part of the impact weight and an outlet is located below the bearing(s), preferably below the lowest bearing. By locating the outlet(s) or at least some outlets for return water below the lowest bearing, (part of) the return water is directed through the bearing, and the bearing is continually flushed and/or lubricated with return water.

In a further embodiment, the pile driver system comprises a filter located upstream from the valves, preferably upstream from the pump. The filter preferably removes particles in excess of 50 μm, preferably in excess of 25 μm, and more preferably in excess of 10 μm, i.e. removes at least 90% of particles having an effective diameter larger than the limits specified. Filtering the driving water enables tighter tolerances in the components downstream, in particular in relatively delicate components, such as the pilot valves that are often employed to control the main hydraulic valves. This in turn enables more efficient operation of the driver, i.e. at an the efficiency close or equal to that of pile drivers using oil as an hydraulic medium.

Typically, the pump(s) and filter are located on deck of a surface vessel. However, if the pump(s) and filter are located near or even on or in the submerged pile driver, a supply line for the pressurized water is no longer required, simplifying e.g. the umbilical.

In an embodiment, the impact weight is driven upwards and then downwards by the pressurized water. In such an embodiment, the one or more valves are arranged to alternately direct pressurised water to opposite sides of the piston, in particular to the so-called lifting and acceleration surfaces of the piston. Such pile drivers can be operated with a smaller pump, compared to pile drivers having a hydraulic circuit comprising a gas spring.

An aspect of the invention further relates to a method of installing or removing foundation elements, such as piles, anchors, and conductors, in a sub-sea ground formation, comprising the steps of mounting the pile driver on a foundation element, filling, e.g. flooding the cavity with water, driving the foundation element into respectively out of the ground formation by alternately lifting and accelerating the impact weight respectively away from and towards the element using water taken from the surroundings as an hydraulic medium, and returning the water to the surroundings via the cavity. In an embodiment, at least part of the water is returned to the surroundings via the bottom of the housing, the water thus flowing around the impact weight and preferably through the upper and lower bearings.

BRIEF DESCRIPTION OF THE DRAWINGS

The invention will now be explained in more detail with reference to the FIGURE. It is noted that the FIGURE is schematic in nature and that details, which are not necessary for understanding the present invention, may have been omitted.

DETAILED DESCRIPTION OF THE ILLUSTRATIVE EMBODIMENTS

The FIGURE shows an embodiment of a pile driver 1 according to the present invention for installing or removing foundation elements, such as piles, anchors, and conductors, in a subsea ground formation, which comprises a closed housing 2 defining a cavity 3, an impact weight 4 accommodated inside the housing 2, i.e. in the cavity and enveloped by the housing, and slidingly mounted in upper and lower bearings 5,6, a hydraulic circuit for reciprocating the impact weight 4, and a pump unit for withdrawing and filtering water from the sea and providing pressurized water to the hydraulic circuit.

In this example, the hydraulic circuit comprises two valves 7,8, a hydraulic cylinder 9, and a piston 10 accommodated in the cylinder and connected to the impact weight by means of a piston rod 10A guided in the upper bearing 5. It is generally preferred that the piston 10 and piston rod 10A form an integral part of the impact weight. The hydraulic cylinder 9 is provided with openings 11 in its wall near its upper end, through which the cylinder 9 communicates with one or more chambers, in this example an annular chamber 12 completely surrounding the cylinder 9.

A first conduit 13 directly connects a pump unit 27, 29 to the space in the hydraulic cylinder 9 beneath the piston 10, to supply pressurized water to the lower or lifting surface of the piston 10 and to a high pressure accumulator 14 accommodated in the chamber 12. The accumulator, known in itself, suppresses extreme variations in pressure in the hydraulic circuit.

A second conduit 15 connects the pump 27, 29, via the first or supply pressure valve 7 to the space in the hydraulic cylinder 9 above the piston 10 or, in this example, a lumen inside the piston 10 and piston rod 10A to supply pressurized water to the (effective) upper surface of the piston 10, i.e. the cross-sectional area of the lumen. The (effective) upper surface of the piston 10 is larger than lower surface of piston 10—which surface, incidentally, is defined by an annular notch 16 at the transition between the piston 10 and the piston rod 10A—, to generate a net downwards force when the pressure above the piston 10 is equal to that beneath the piston 10.

A third conduit 17 connects the second conduit 15, via the second or return pressure valve 8 to the annular chamber 12 surrounding the hydraulic cylinder 9.

The annular chamber 12 communicates with the cavity 3 in the housing 2 accommodating the impact weight 4 through one or more passages 18 extending e.g. parallel to the upper bearing 5. Further passages 19 connect the cavity 3 with the space beneath the lower bearing 6, which space, in this example, accommodates a shock absorber pack 20 and a shock plate 21, both known in themselves. In embodiments comprising one or more bearings and passages arranged in parallel with the bearing(s), the flow through the bearing(s) can be set and adjusted by means of throttles, e.g. throttle valves positioned in the bearing(s) (herein schematically indicated at 19A).

The lower end of the pile driver 1 is provided with a sleeve 22 with which the driver 1 is mounted on a foundation element, in this case a monopile 23, with an anvil 24 interposed between the two. Proximity sensors 25 are positioned on the inner wall of the cavity 3 to establish position and speed of the impact weight 4. Finally, the driver comprises a plurality of exhaust openings 26, located in the shock plate 21, to return the driving water to the surroundings, in this case to the sleeve 22.

The pump unit is located on deck of a surface vessel and comprises a high pressure positive displacement pump 27, a filter 28 located upstream from the high pressure pump 27, and a low pressure feed pump 29 upstream from the filter 28. The filter 28 comprises three stages, viz. an automatic filter removing particles in excess of 50 μm, an intermediate filter removing particles in excess of 25 μm, and an bag filter removing particles in excess of 10 μm.

When the pile driver 1 is submerged, flooded and mounted on a pile 23, it is operated as follows. Initially, both valves 7,8 are open and the pumps 27,29 are started. Thus, water is withdrawn from the surroundings, filtered and pumped through the supply pressure valve 7, the annular chamber 12, the upper bearing 5 and the passages 18 connecting the annular chamber 12 to the cavity 3, past the impact weight 4, and through the lower bearing 6, the corresponding passages 19, and the exhaust openings 26 to the surroundings. Both sides of the piston 10 are exposed to the pressure in the circuit, maintaining the impact weight 4 in its lowermost position.

When the supply pressure valve 7 is closed, pressurized water is directed exclusively to the space in the hydraulic cylinder 9 beneath the piston 10 and to the accumulator 14, pressure increases and the impact weight 4 is lifted. Water contained in the hydraulic cylinder 9 above the piston 10 is expelled into the annular chamber 12 and towards the cavity 3 causing a downward flow inside the latter and along the impact weight 4, which flow more than compensates the pumping action of the weight 4 moving upwards. Upon lapse of a preset lift time or reaching a preset stroke, the supply pressure valve 7 is opened and the impact weight 4 stops moving upwards. Next, the return pressure valve 8 is closed and pressurized water is directed to the (effective) upper surface of the piston 10 and the impact weight 4 is accelerated towards the pile 23 until is hits the anvil 24. Water contained in the hydraulic cylinder 9 below the piston 10 is expelled into the hydraulic circuit, mostly into the accumulator 14. After impact, the cycle is started anew.

By returning the pressurized water to the surroundings via the cavity 3, ingress of water and dirt directly from the surroundings into the cavity 3 is reduced or prevented. Further, as the system of the present invention provides a controlled environment, results during actual operation more closely correspond the results achieved during testing in a laboratory. This in turn facilitates optimization of operating conditions and settings and further development of the driver 1. Finally, as the system continuously withdraws and returns water from respectively to the surroundings, it requires in principle no tank for a hydraulic medium low pressure or low pressure accumulator and no so-called scavenger for re-generating the hydraulic medium.

As a matter of course, this disclosure is not restricted to the above-disclosed embodiments, which may be varied in different manners within the spirit and scope of the invention.

The invention claimed is:

1. A driver system for installing or removing foundation elements in a subsea ground formation, comprising a closed housing defining a cavity, an impact weight accommodated inside the housing, a hydraulic circuit configured to reciprocate the impact weight, which circuit comprises one or more valves, a cylinder, a piston accommodated in the cylinder and connected to the impact weight, and an exhaust, the exhaust fluidly coupled to a passage that extends between the hydraulic circuit and the cavity, a pump configured to withdraw water from the surroundings of the pile driver and providing pressurized water to the hydraulic circuit, and at least one outlet configured to return water to the surroundings wherein the exhaust of the hydraulic circuit passes water through the passage from the hydraulic circuit to the cavity and in that the at least one outlet is located in a wall of the housing.

2. The driver system according to claim 1, wherein the at least one outlet is located near or in a bottom of the housing on a side of the impact weight opposite from the piston.

3. The driver system according to claim 1, comprising a bearing configured to guide a part of the impact weight using water from the cavity.

4. The driver system according to claim 3, comprising one or more passages open to the cavity arranged in parallel with guided movement provided by the bearing.

5. The driver system according to claim 4, and a throttle configured to control flow through one or more of the passages.

6. The driver system according to claim 3 and wherein the at least one outlet is configured to discharge water used by the bearing.

7. The driver system according to claim 1, comprising a filter located upstream from the one or more valves.

8. The driver system according to claim 1, comprising a filter located upstream from the pump.

9. The driver system according to claim 8, wherein the filter is configured to remove particles in excess of 50 μm from the water withdrawn from the surroundings.

10. The driver system according to claim 8, wherein the filter is configured to remove particles in excess of 25 μm from the water withdrawn from the surroundings.

11. The driver system according to claim 8, wherein the filter is configured to remove particles in excess of 10 μm from the water withdrawn from the surroundings.

12. The driver system according to claim 1, comprising a filter fluidly connected to the pump and a feed pump fluidly connected upstream from the filter.

13. The driver system according to claim 1, wherein the passage is configured to receive and pass through to the cavity all water exhausted through the exhaust of the hydraulic circuit.

14. The driver system according to claim 1, wherein the outlet is configured to return to the surroundings all water exhausted into the cavity through the passage.

15. A method of installing or removing foundation elements in a sub-sea ground formation, by means of a driver comprising a closed housing defining a cavity, an impact weight accommodated inside the housing, and an hydraulic circuit for lifting and/or accelerating the impact weight respectively away from and towards the element, the method comprising:

mounting the driver on a foundation element, driving the foundation element by alternately lifting and accelerating the impact weight respectively away from and towards the foundation element using water taken from the surroundings as an hydraulic medium, and passing water through a passage in the housing from the hydraulic circuit and into the cavity and returning the water to the surroundings via the cavity.

16. The method according to claim 15, wherein at least part of the water is returned to the surroundings at least proximate an end of the housing.

17. The method according to claim 15, wherein the driver comprises a bearing for guiding a part of the impact weight and the method comprises directing water through the bearing.

18. The method according to claim 15, and further comprising filtering the water before it is fed to the hydraulic circuit.

19. The method according to claim 15, wherein particles in excess of 50 μm are removed from the water.

20. The method according to claim 15, wherein particles in excess of 25 μm are removed from the water.

21. The method according to claim 15, wherein particles in excess of 10 μm are removed from the water.

22. The method according to claim 15 wherein the foundation element comprises a pile.

23. The method according to claim 15 wherein the foundation element comprises an anchor.

24. The method according to claim 15 wherein the foundation element comprises a conductor.

* * * * *